US008070529B2

(12) United States Patent
Xiong et al.

(10) Patent No.: US 8,070,529 B2
(45) Date of Patent: Dec. 6, 2011

(54) ELECTRICAL CONNECTOR WITH IMPROVED CONTACT STRUCTURE

(75) Inventors: Feng Xiong, Kunshan (CN); Hong-Qiang Han, Kunshan (CN); Lun-Song Hu, Kunshan (CN); Zi-Qiang Zhu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 182 days.

(21) Appl. No.: 12/472,392

(22) Filed: May 27, 2009

(65) Prior Publication Data

US 2009/0298351 A1 Dec. 3, 2009

(30) Foreign Application Priority Data

May 29, 2008 (CN) ..... 2008 2 0037488

(51) Int. Cl.
*H01R 24/00* (2006.01)

(52) U.S. Cl. ..... 439/676; 439/620.15

(58) Field of Classification Search ..... 439/676, 439/620.01, 620.15, 620.16, 79
See application file for complete search history.

(56) References Cited

U.S. PATENT DOCUMENTS 5,439,385 A * 8/1995 Sakai et al. ..... 439/79
5,975,917 A * 11/1999 Wang et al. ..... 439/79
7,331,801 B1 * 2/2008 Eichorn ..... 439/79
7,344,412 B2 * 3/2008 Sato ..... 439/607.28

OTHER PUBLICATIONS

VESA DisplayPort Standard, Version 1, Revision 1a, Jan. 11, 2008, pp. 201-205.

* cited by examiner

*Primary Examiner* — Tulsidas C Patel
*Assistant Examiner* — Travis Chambers
(74) *Attorney, Agent, or Firm* — Wei Te Chung; Andrew C. Cheng; Ming Chieh Chang

(57) ABSTRACT

An electrical connector (100) having an inserting port (102) for receiving a corresponding plug, includes an insulative housing (1) and a plurality of contacts (4) retained in the insulative housing (1). Each contact (4) has a first portion (41) extending horizontally into the inserting port (102), a first bending portion (43) bending downwardly from a rear end of the first portion (41), and a second portion (42) extending downwardly from the first bending portion (43). The contacts (4) are arranged in two groups. The first portions (41) of each contact group (401, 402) are arranged in a row along a transverse direction respectively. The second portions (42) in each contact group (401, 402) are arranged in at least two rows along a front-to-back direction respectively. The first bending portions (43) of the contacts (4) in each contact group are arranged in a line along the transverse direction respectively.

18 Claims, 8 Drawing Sheets

ELECTRICAL CONNECTOR WITH IMPROVED CONTACT STRUCTURE

BACKGROUND OF THE INVENTION

1. Field of the Invention

The present invention relates to an electrical connector, and more particularly to electrical connectors with improved contact structure.

2. Description of Related Art

Electrical connectors with high transmitting speed, such as HDMI (High-Definition Multimedia Interface), Displayport etc, are widely used on TVs, computers, etc. Such an electrical connector usually includes an insulative housing and a plurality of differential signal contacts and grounding contacts retained in the insulative housing. The insulative housing has a base portion and a tongue extending forwardly from the base portion. The contacts are arranged in two groups which comprise a first contact group retained on an upper side of the tongue and a second contact group retained on a lower side of the tongue. Each contact has a contact portion extending to the tongue and a tail portion bending perpendicularly downwardly from the contact portion.

The first and second contact groups each comprises a number of signal contacts and a plurality of grounding contacts between adjacent signal contacts. The tail portions are usually arranged in three rows along a front-to-back direction for increasing space between adjacent contacts and decreasing crosstalk with each other. The signal contacts are arranged in an inner row and an outer row, and the grounding contacts are arranged in a middle row. The tail portions in each contact group need to be arranged in at least two rows and bend from different positions of the contact portions. Thereby, at least two molds are needed to form each contact group, and each contact group needs to be divided in two rows and separately assembled into the insulative housing. It needs much time to be assembled, and the cost of mold manufacture can not be decreased easily.

Hence, an electrical connector is desired to overcome the disadvantage of the prior art.

BRIEF SUMMARY OF THE INVENTION

According to one aspect of the present invention, an electrical connector having an inserting port for receiving a corresponding plug, comprises an insulative housing and a plurality of contacts retained in the insulative housing. Each contact has a first portion extending horizontally into the inserting port, a first bending portion bending downwardly from a rear end of the first portion, and a second portion extending downwardly from the first bending portion. The contacts are arranged in a first contact group and a second contact group, the first portions in each contact group are arranged in a row along a transverse direction respectively. The second portions in each contact group are arranged in at least two rows along a front-to-back direction respectively. The first bending portions of the contacts in each contact group are arranged in a line along the transverse direction respectively.

According to another aspect of the present invention, an electrical connector comprises: an insulative housing having a base portion and a tongue extending forwardly from the base portion; and a plurality of contacts retained in the insulative housing, each contact has a securing portion retained in the base portion, a contact portion extending horizontally to the tongue from the securing portion, a first bending portion bending downwardly from a rear end of the securing portion, a connecting portion extending downwardly from the first bending portion, and a tail portion extending perpendicularly downwardly from the connecting portion; wherein the contact portions are arranged in an upper row and a lower row, the contact portions of the upper row and the lower row are respectively located at two opposite sides of the tongue, the connecting portions are arranged in four rows along a front-to-back direction, the tail portions are arranged in three rows along the front-to-back direction, and the first bending portions corresponding to the contact portions in each row are located at a same line along a transverse direction respectively.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
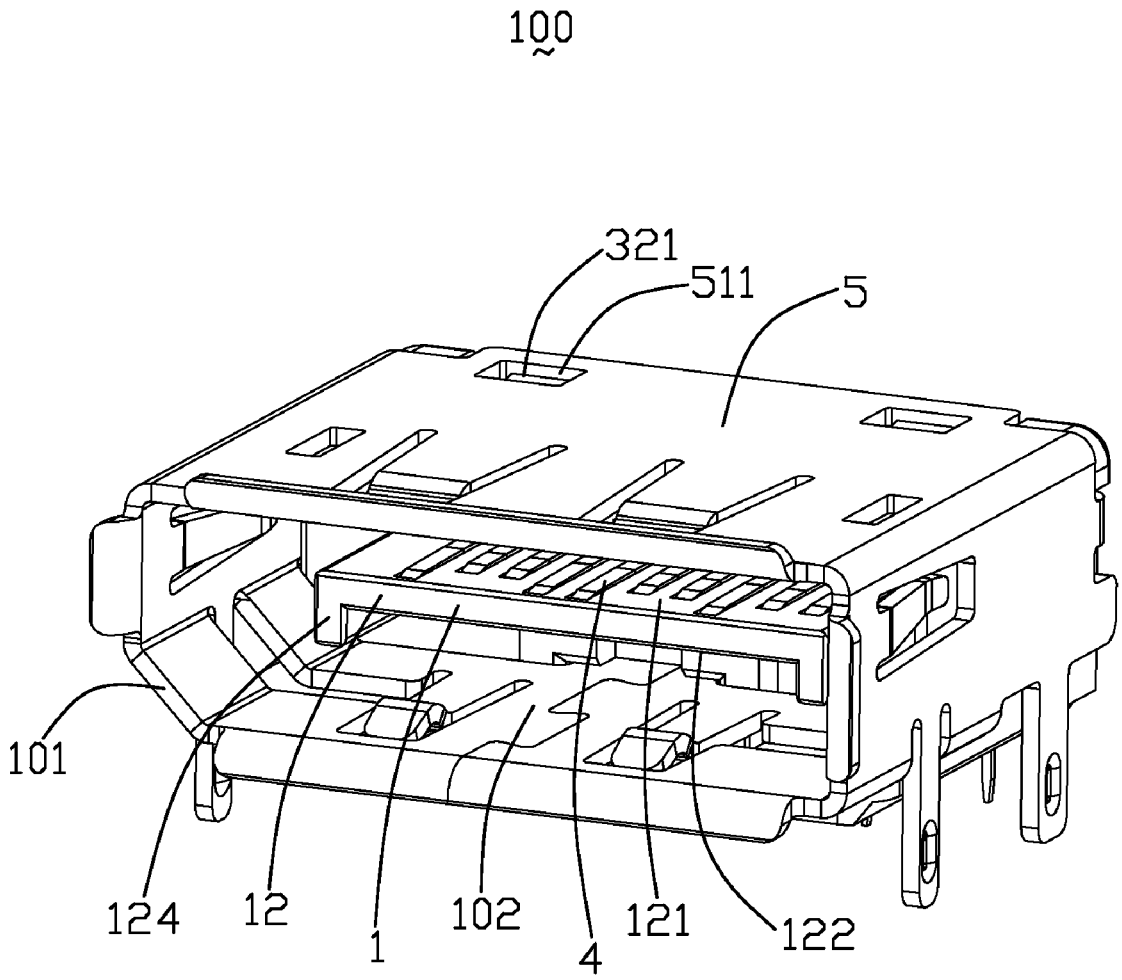
FIG. 1 is a perspective view of an electrical connector according to the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-6, an electrical connector 100 according to the present invention is disclosed. The electrical connector 100 has a mating face 101 and an inserting port 102 extending inwardly from the mating face 101 for receiving a corresponding plug (not shown). The electrical connector 100 comprises an insulative housing 1, a plurality of contacts 4 retained in the insulative housing 1, a spacer 2 retained on the insulative housing 1 for positioning the contacts 4, a metal shell 5 and a rear cover 3 covering the insulative housing 1.

Figure 5:
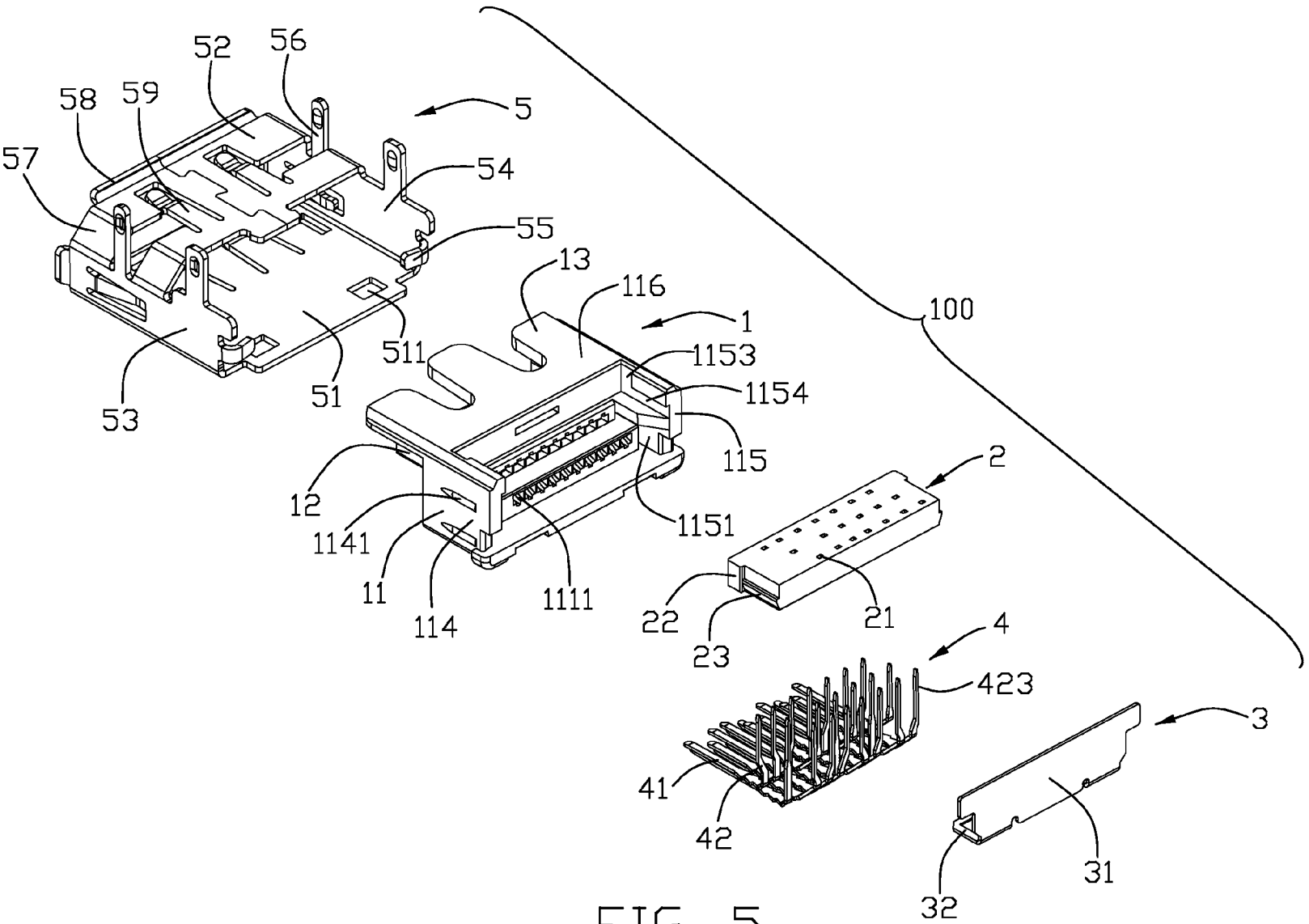
FIG. 5 is an exploded view of the electrical connector shown in FIG. 1.
Figure 6:
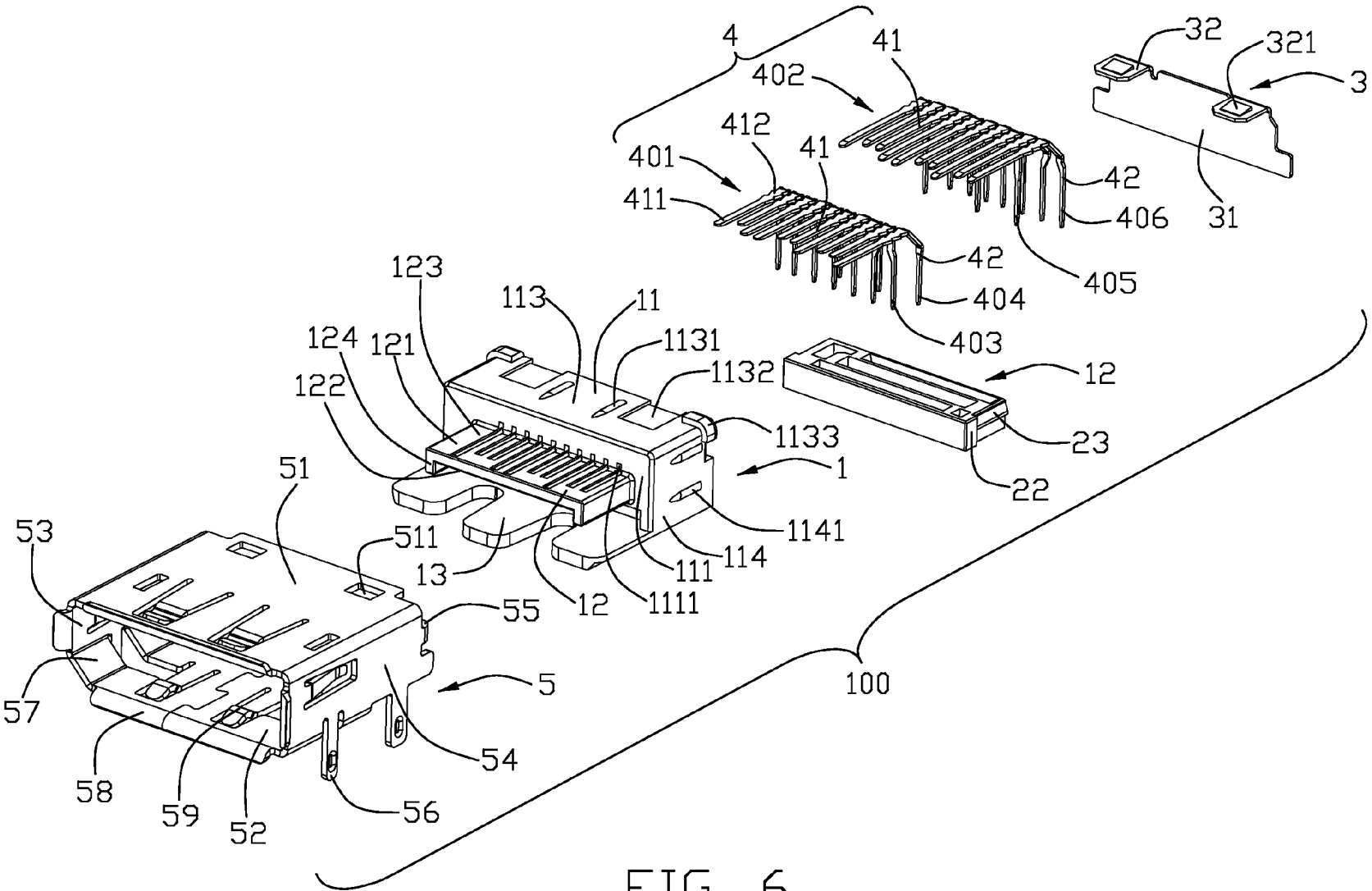
FIG. 6 is a view similar to FIG. 5, while taken from another aspect.

Referring to FIGS. 5-6, the insulative housing 1 has a base portion 11, a tongue 12 extending forwardly from a middle portion of the base portion 11, and an assistant plate 13 extending forwardly from the bottom of the base portion 11 and parallel to the tongue 12. The base portion 11 has a pair of opposite front face 111 and rear face 115, a pair of opposite top face 113 and bottom face 116, and a pair of side faces 114. The base portion 11 defines a plurality of passageways 1111 extending through the front face 111 and the rear face 115, a cavity 1151 extending inwardly from the rear face 115 for receiving the contacts 4 and the spacer 2, a vertical slot 1153 and a level slot 1154 located at two outsides of the cavity 1151 and communicating with the cavity 1151. The top wall 113 and side walls 114 have a plurality of ribs 1131, 1141 for engaging with the metal shell 5. The top wall 112 defines a pair of recesses 1132 and a pair of protrusions 1133 for engaging with the rear cover 3 and the metal shell 5. The tongue 12 has a plate portion 123 and two flanges 124 extending perpendicularly downwardly from two ends of the tongue 12 for preventing the plug from mismating. The plate portion 123 has an upper surface 121 and a lower surface 122. The passageways 1111 extend to the upper and lower surface 121, 122.

Figure 2:
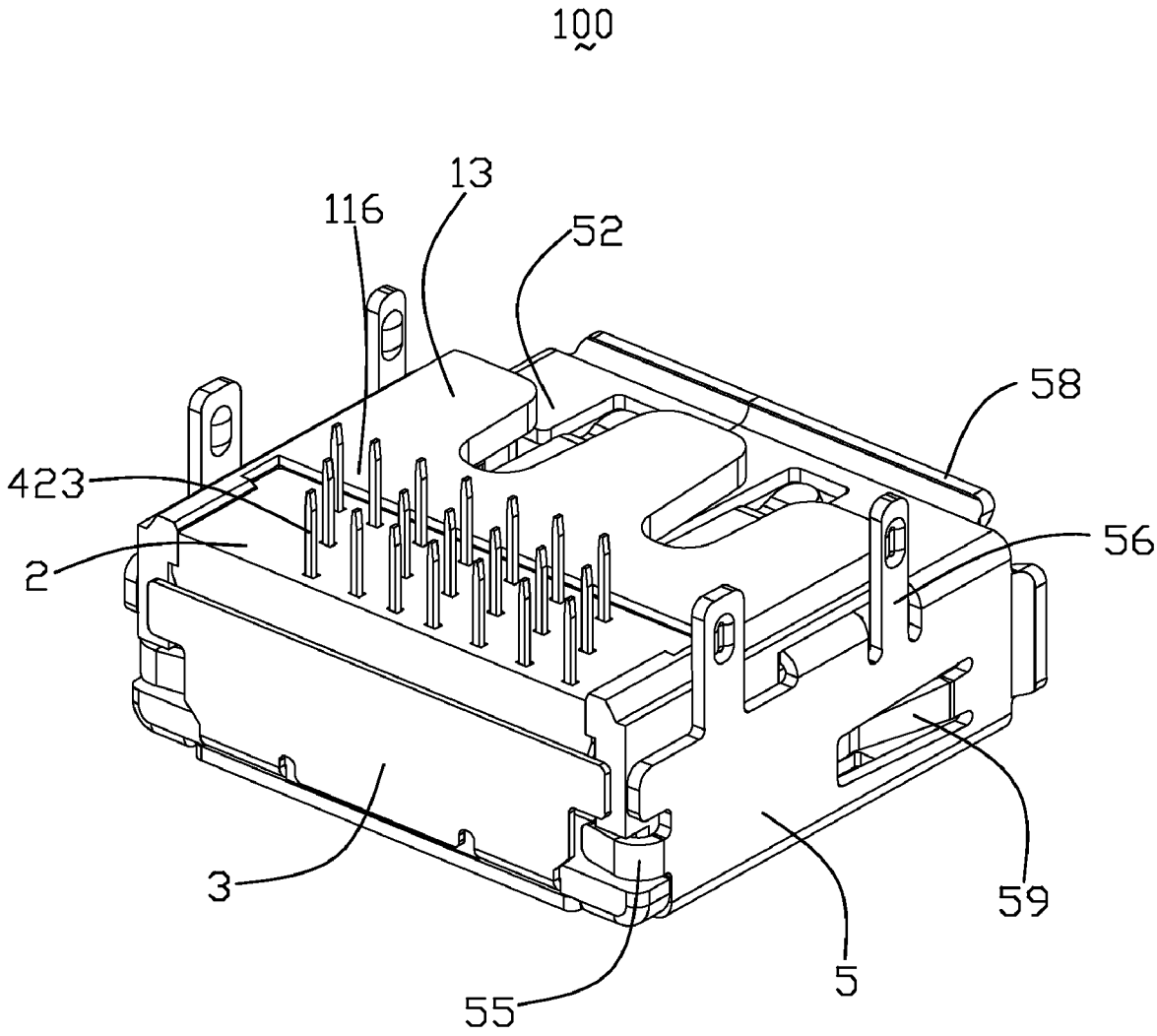
FIG. 2 a view similar to FIG. 1, while taken from another aspect.
Figure 3:
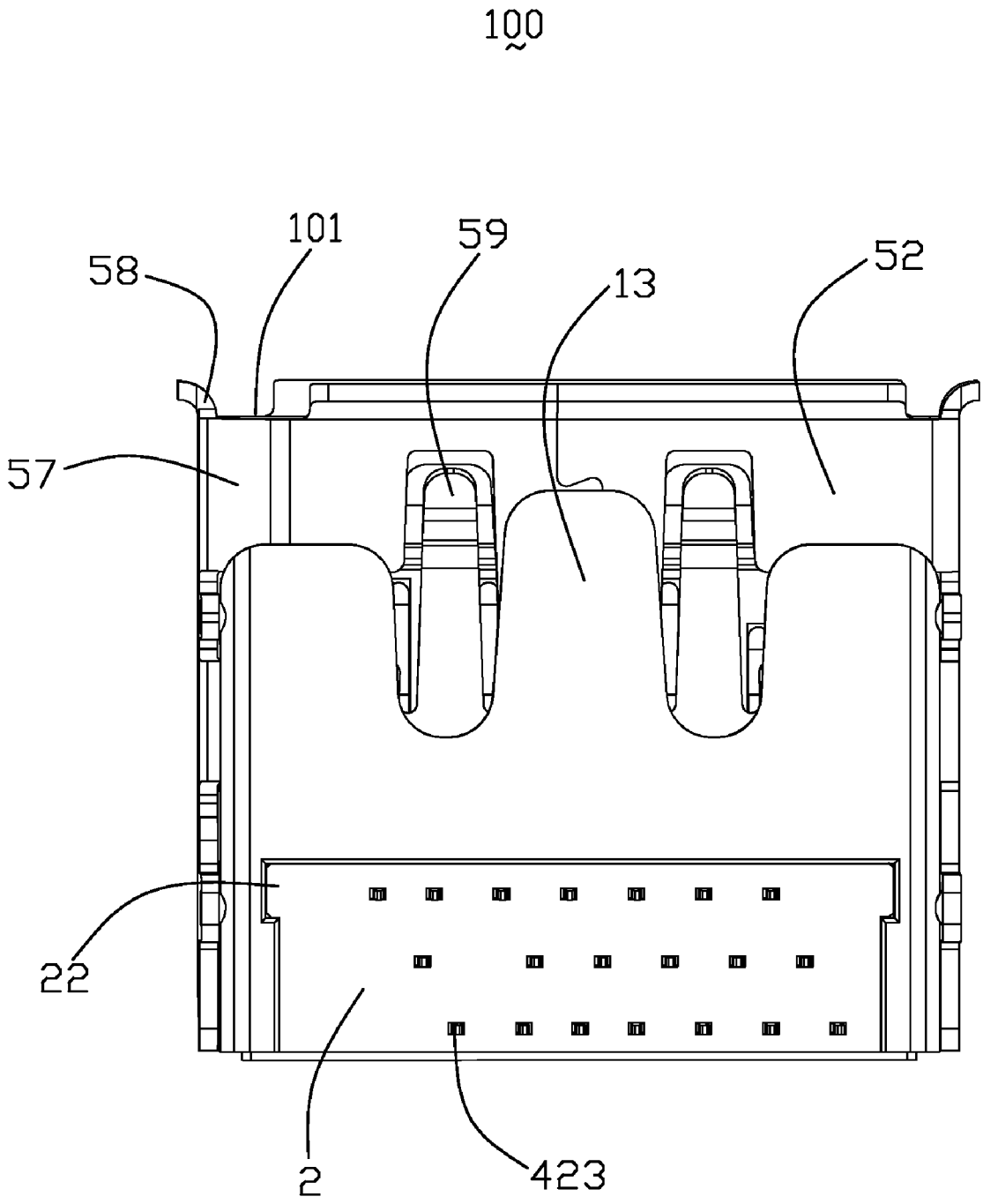
FIG. 3 is a bottom plan view of the electrical connector shown in FIG. 1.
Figure 4:
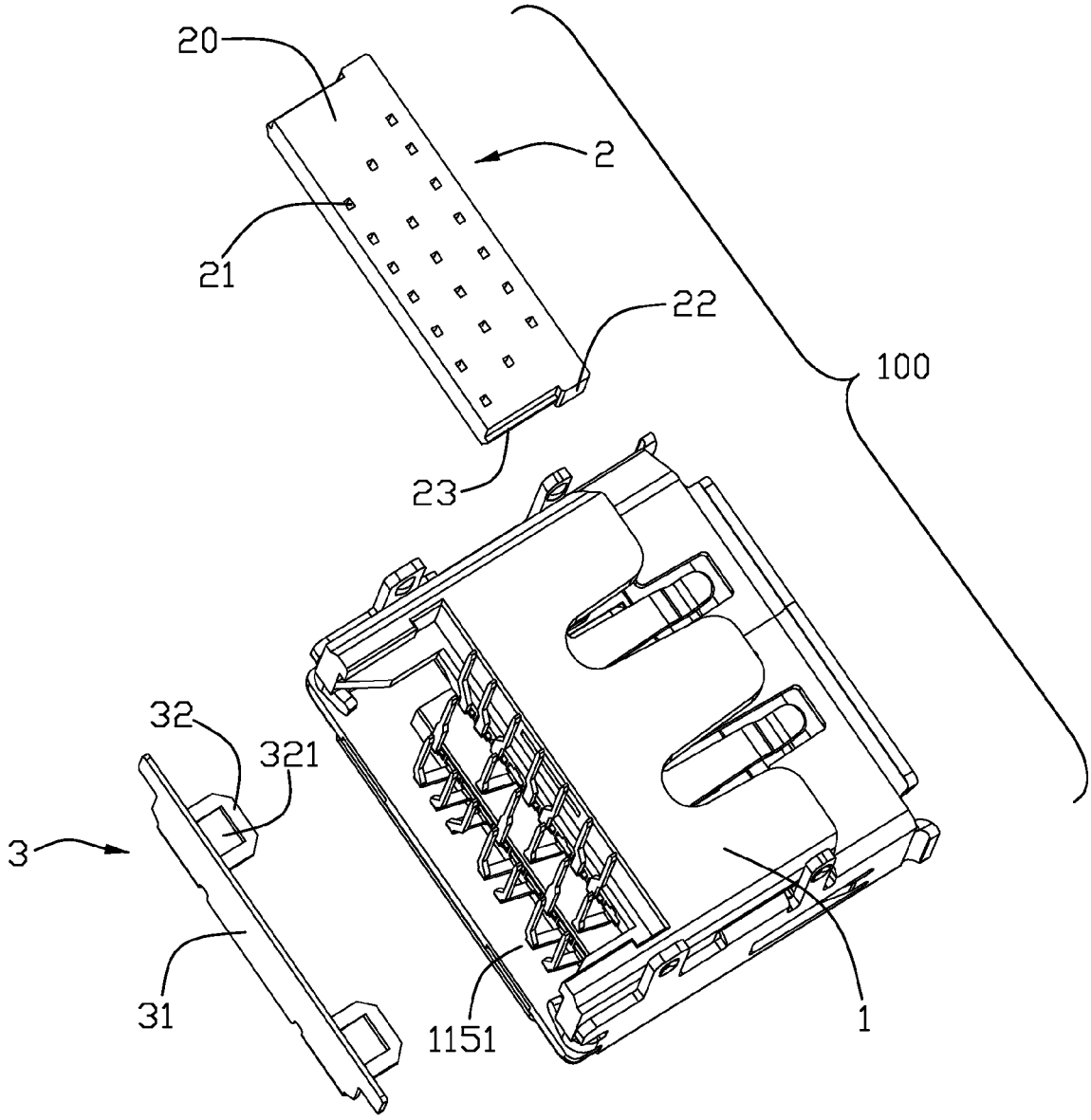
FIG. 4 is a partial exploded view of the electrical connector shown in FIG. 1.

Referring to FIGS. 2-4, the spacer 2 is a rectangular insulator which is retained in the cavity 1151. Each side of the spacer 2 has a vertical block 22 and a horizontal block 23 respectively received in the vertical slot 1153 and the level slot 1154 for retaining the spacer 2 to the insulative housing 1. The spacer 2 defines a plurality of through holes 21 to position the contacts 4.

Referring to FIGS. 2-6, the rear cover 3 is retained on a rear side of the insulative housing 1 for covering the cavity 1151 and shielding the contacts 4. The rear cover 3 has a body portion 31 and two locking portions 32 extending forwardly from a top end of the body portion 31 and received in the recess 1132. Each locking portion 32 has a spring tab 321 to engage with the metal shell 5.

Referring to FIGS. 1, 2, 5 and 6, the metal shell 5 rings on the outside of the insulative housing 1, and comprises a pair of opposed top wall 51 and bottom wall 52, and a pair of opposed first side wall 53 and second side wall 54. The inserting port 102 is formed by the top wall 51, bottom wall 52, and the first and second side walls 53, 54. Each top wall 51, bottom wall 52, and first and second side walls 53, 54 has at least a spring arm 59 for engaging with the plug, and a flange 58 for abutting against a shell of a computer (not shown). The metal shell 5 has an oblique wall 57 connecting the first side wall 53 and the bottom wall 52 for preventing the plug from mismating. The top wall 51 defines a pair of locking holes 511 for engaging with the spring tabs 321. The metal shell 5 has two pairs of mounting legs 56 respectively extending from the first and second side walls 53, 54. The side walls 53, 54 each has a draw 55 locking with the rear face 115 of the insulative housing 1. A rear end of the metal shell 5 abuts against the protrusions 1133 for preventing the metal shell 5 from moving backwardly.

Referring to FIGS. 1-8, the contacts 4 are stamped from a metal sheet. Each contact 4 has a first portion 41 extending horizontally into the inserting port 102, a first bending portion 43 extending downwardly from a rear end of the first portion 41, and a second portion 42 extending downwardly from a rear end of the first portion 41. The first portion 41 has a horizontal securing portion 412 retained in the passageways 1111 of the base portion 11, and a contact portion 411 extending to the passageways 1111 of the tongue 12 and exposed to the inserting port 102 to contact with the plug. The second portion 42 has a connecting portion 424 extending downwardly from the first bending portion 43 and a tail portion 423 extending perpendicularly downwardly from the connecting portion 424 to connect with a circuit board (not shown).

The contacts 4 are arranged in two groups which comprise a first contact group 401 and a second contact group 402. The first portions 41 of each contact groups 401, 402 are arranged in a row along a transverse direction respectively. The first portions 41 in the first contact group 401 are located at a lower row retained on the lower surface 122 of the tongue 12, and the first portions 41 in the second contact group 402 are located at an upper row retained on the upper surface 121 of the tongue 12. The first bending portions 43 in the first contact group 401 are located at a line along the transverse direction, and the first bending portions 43 in the second contact group 402 are located at another line behind the first bending portions in the first contact group 401 and higher than the first bending portions 43 in the first contact group 401. Thereby, the first contact group 401 and the second contact group 402 can be stamped by one mold (not shown) respectively. The cost of the mold manufacture is decreased.

The structures of the contacts 4 in the first contact group 401 are similar to that in the second contact group 402, the first contact group 401 will be described detailedly at following only. The first contact group 401 comprise a plurality of first contacts 403 with second portions 42 extending perpendicularly downwardly from the first bending portions 43, and a plurality of second contacts 404 with second portions 42 extending obliquely, backwardly and downwardly from the first bending portions 43. The connecting portions 424 of the first contacts 403 extend perpendicularly downwardly from the first bending portions 43, and the tail portions 423 of the first contacts 403 extend vertically from a lower end of the connecting portions 424. The connecting portions 424 of the second contacts 404 extend obliquely, backwardly and downwardly from the first bending portions 43, and the tail portions 423 of the second contacts 404 extending perpendicularly downwardly from a lower end of the connecting portions 424. Therefore, the second portions 42 of the second contacts 404 each has a second bending portion 44 bending downwardly from a lower end of the connecting portions 424 and connecting the connecting portions 424 and the tail portions 423 together. Because the first bending portions 43 in the first contact group 401 are located at a line, and the second portions 42 of the second contacts 404 have the second bending portions 44, the second portions 42 of the first contacts 403 and the second contacts 404 in the first contact group 401 are located at two rows along a front-to-back direction respectively. Wherein the second portions 42 of the first contacts 403 in the first contact group 401 are located at a front row, and the second portions 42 of the second contacts 404 in the first contact group 401 are located at a rear row behind the front row.

Figure 7:
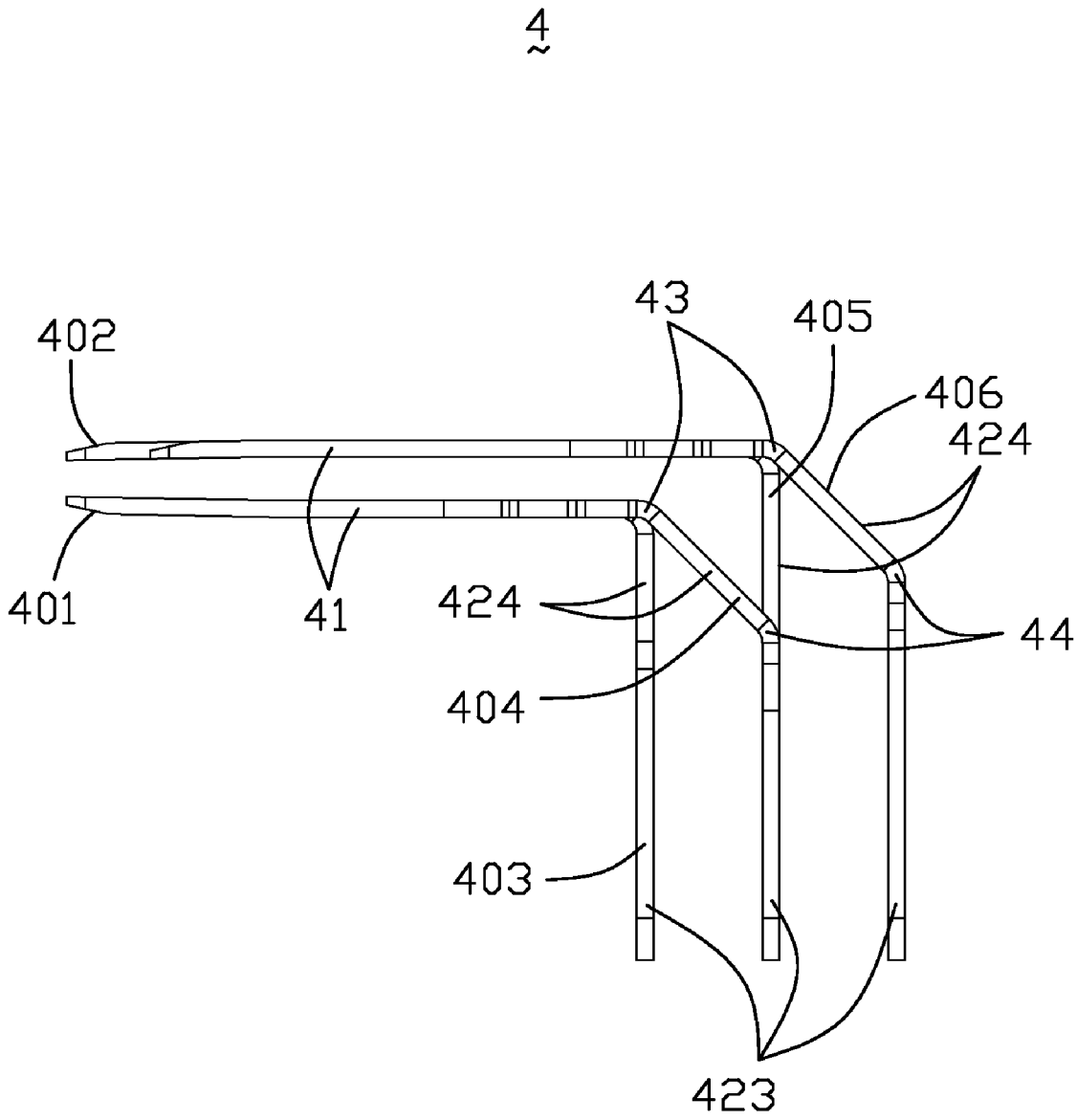
FIG. 7 is a right side elevational view of contacts of the electrical connector shown in FIG. 1.
Figure 8:
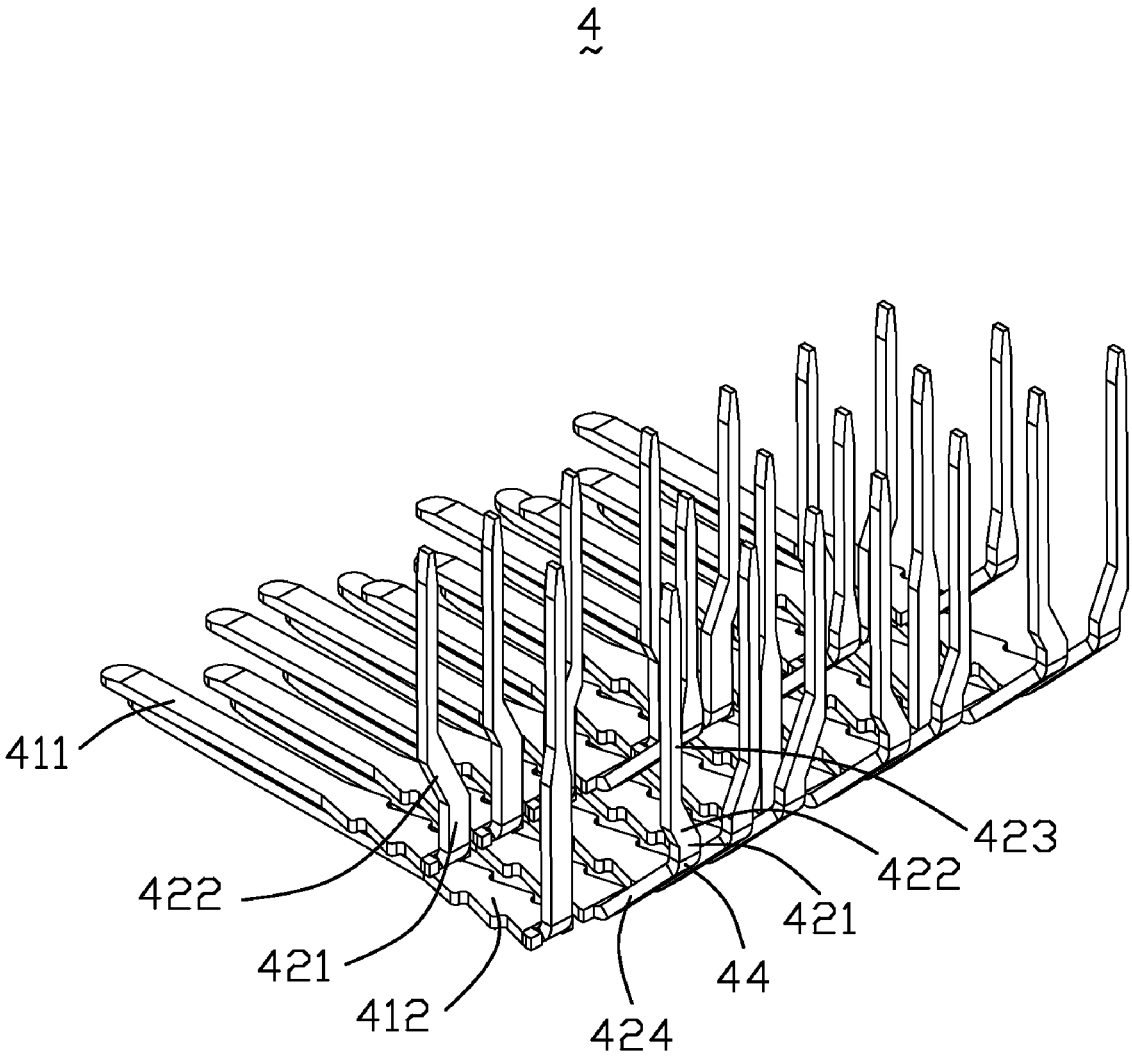
FIG. 8 is a perspective view of the contacts in FIG. 7.

The second contact group 402 have a plurality of first contacts 405 similar to that of the first contact group 401, and a plurality of second contacts 406 similar to that of the first contact group 401. Referring to FIGS. 7 and 8, when the first contact group 401 and the second contact group 402 are assembled into the insulative housing 1, the tail portions 423 of the first contacts 403 are arranged in the first row, the tail portions 423 of the first contacts 405 and the second contacts 404 are aligned with each other along the transverse direction to form a second row behind the first row along the front-to-back direction, and the tail portions 423 of the second contacts 406 are arranged in a third row behind the second row. Therefore, the tail portions 423 of all contacts 4 are arranged in three rows. The connecting portions 424 of the first contacts 405 and the second contacts 404 are spaced apart from each other along the front-to-back direction, therefore, the connecting portions 424 are arranged in four rows along the front-to-back direction. In addition, the connecting portions 424 of the second contacts 404 are parallel to that of the second contacts 406 and define a length equal to that of the second contacts 406, therefore, the spaces between adjacent two rows of the tail portions 423 are equal to each other.

The contacts 4 corresponding to the second row tail portions 423 are grounding contacts, and the contacts 4 corresponding to the other two rows tail portions 423 are signal contacts. The grounding contacts are arranged between the signal contacts for decreasing disturb between the signal contacts. The connecting portions 424 of the first contacts 403, 405 in the present invention each has an extended portion 421 extending downwardly from the first bending portion 43, and an inclined portion 422 extending sideward from the extended portion 421 for increasing space therebetween. The tail portions 423 of the second contacts 404, 406 each has an extended portion 421 extending downwardly from the second bending portion 44, and an inclined portion 422 extending sideward from the extended portion 421 for increasing space therebetween.

As fully described above, the first bending portions 43 in the first and second contact group 401, 402 are located at a line along the transverse direction respectively. Thereby, the first contact group 401 and the second contact group 402 can be stamped by one mold respectively. The cost of the mold manufacture can be decreased. In addition, the tail portions 423 of the contacts 4 are arranged in three rows, the space between adjacent contacts is increased for decreasing disturb therebetween. Of course, the tail portions 423 of the contacts 4 in the other embodiment can be arranged in four or even more rows to increase the space therebetween.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector having an inserting port for receiving a corresponding plug, comprising:

an insulative housing; and a plurality of contacts retained in the insulative housing, each contact having a first portion extending horizontally into the inserting port, a first bending portion bending downwardly from a rear end of the first portion, and a second portion extending downwardly from the first bending portion, the contacts being arranged in a first contact group and a second contact group, the first portions in each contact group being arranged in a row along a transverse direction respectively, and the second portions in each contact group being arranged in at least two rows along a front-to-back direction respectively;

wherein all the first bending portions in each contact group are arranged in a line along the transverse direction respectively.

2. The electrical connector according to claim 1, wherein the first portions of the first contact group are arranged in a lower row, and the first portions of the second contact group are arranged in an upper row parallel to the lower row.

3. The electrical connector according to claim 2, wherein the first contact group has a plurality of first contacts with second portions thereof extending perpendicularly downwardly from the first bending portions thereof, and a plurality of second contacts with second portions thereof bending obliquely, backwardly and downwardly from the first bending portions thereof.

4. The electrical connector according to claim 3, wherein the second portions of the first contacts are arranged in a first row, and the second portions of the second contacts are arranged in a second row behind the first row.

5. The electrical connector according to claim 3, wherein the second portions of the second contacts each has a connecting portion connecting with the first bending portion thereof and extending obliquely, backwardly and downwardly, a second bending portion bending downwardly from a lower end of the connecting portion thereof, and a tail portion extending perpendicularly downwardly from the second bending portion thereof, the second bending portions of the second contacts are arranged in a line along the transverse direction.

6. The electrical connector according to claim 5, wherein the second contact group is similar to the first contact group, wherein the first bending portions in the second contact group are located behind the first bending portions in the first contact group and higher than the first bending portions in the first contact group, the connecting portions of the second contacts in the first contact group are parallel to that in the second contact group and define a length equal to that in the second contact group.

7. The electrical connector according to claim 6, wherein second portions of the first contacts in the second contact group are located at a same row with the tail portions of the second contacts in the first contact group, and the second portions of the second contacts in the second contact group are arranged in another row behind the second portions of the first contacts in the second contact group.

8. The electrical connector according to claim 7, wherein the first contacts in the first contact group and the second contacts in the second contact group are signal contacts, and the second contacts in the first contact group and the first contacts in the second contact group are grounding contacts.

9. The electrical connector according to claim 1, wherein the insulative housing has a tongue received in the inserting portion, the first portions in the first contact group and second contact group are located at two sides of the tongue respectively.

10. The electrical connector according to claim 9, wherein each first portion has a securing portion engaging with the insulative housing and a contact portion extending forwardly from the securing portion.

11. An electrical connector comprising:

an insulative housing having a base portion and a tongue extending forwardly from the base portion; and a plurality of contacts retained in the insulative housing, each contact has a securing portion retained in the base portion, a contact portion extending horizontally to the tongue from the securing portion, a first bending portion bending downwardly from a rear end of the securing portion, a connecting portion extending downwardly from the first bending portion, and a tail portion extending perpendicularly downwardly from the connecting portion;

wherein the contact portions are arranged in an upper row and a lower row, the contact portions of the upper row and the lower row are respectively located at two opposite sides of the tongue, the connecting portions are arranged in four rows along a front-to-back direction, the tail portions are arranged in three rows along the front-to-back direction, and all the first bending portions corresponding to the contact portions in each row are located at a same line along a transverse direction respectively.

12. The electrical connector according to claim 11, wherein the contacts corresponding to contact portions in each row comprise a plurality of first contacts and a plurality of second contacts, and the connecting portions of the first contacts extend perpendicularly downwardly from the first bending portions of the first contacts, and the connecting portions of the second contacts extend obliquely, backwardly and downwardly from the first bending portions of the second contacts.

13. The electrical connector according to claim 12, wherein each second contact has a second bending portion connecting the connecting portion and the tail portion thereof, and the second bending portions corresponding to contact portions in each row are arranged in a line along the transverse direction respectively.

14. The electrical connector according to claim 13, wherein the connecting portions of the first contacts corresponding to contact portions in the upper row or the lower row are arranged in a front row, and the connecting portions of the second contacts corresponding to contacts portions in the upper row or the lower row are located at a rear row behind the front row.

15. The electrical connector according to claim 14, wherein the first bending portions corresponding to contact portions in the upper row are located behind that the first bending portions corresponding to contact portions in the lower row and higher than the first bending portions corresponding to contact portions in the lower row, and the connecting portions of the second contacts corresponding to contact portions in the lower row are parallel to that in the upper row and define a length equal to that in the upper row.

16. The electrical connector according to claim 15, wherein the tail portions of the second contacts corresponding to contacts portions in the lower row are located at a same row with the tail portions of the first contacts corresponding to contacts portions in the upper row.

17. An electrical connector comprising:

an insulative housing defining a mating port and a mounting port oppositely;

a first group of contacts including differential pairs of signal contacts and grounding contacts alternately arranged with each other in a transverse direction, said first group of contacts defining first contact sections arranged in a first row in the mating port and first mounting sections arranged in second and third rows in the mounting port;

a second group of contacts including differential pairs of signal contacts and grounding contacts alternately arranged with each other in said transverse direction, said second group of contacts defining second contact sections arranged a fourth row in the mating port opposite to said first row, and second mounting sections arranged in fifth and six rows in the mounting port;

the third row being same with the fifth row, and the second row and the six row being respectively located by two sides thereof;

the first mounting sections of the differential pairs being located in the second row, the second mounting sections of the differential pairs being located in the six row, the first mounting sections of the grounding contact of both the first group and the second group being located in the third row; wherein an internal pitch between the first mounting sections of the differential pair is larger than that between the first contacting sections of the same differential pair; wherein each of the first mounting sections of the grounding contacts includes a first rearwardly and downwardly extending oblique section while each of the second mounting sections of the grounding contacts does not; each of the second mounting sections of the differential pairs includes a second rearwardly and downwardly extending oblique portion while each of the first mounting sections of the differential pairs does not; wherein an upper end of said first rearwardly and downwardly extending oblique section is located in the second row while a lower end of said first rearwardly and downwardly extending oblique section is located in the third row; an upper end of the second rearwardly and downwardly extending oblique section is located in the fifth row while a lower end of said second rearwardly and downwardly extending oblique section is located in the sixth row.

18. The electrical connector as claimed in claim 17, wherein an internal pitch between the first mounting sections of the neighboring grounding contacts is essentially same with that between the first mounting sections of said same neighboring grounding contacts.

* * * * *